US012077953B2

(12) United States Patent
Tash

(10) Patent No.: US 12,077,953 B2
(45) Date of Patent: Sep. 3, 2024

(54) FLEXIBLE PLUNGER BOOT

(71) Applicant: George Tash, Moorpark, CA (US)

(72) Inventor: George Tash, Moorpark, CA (US)

(73) Assignee: Adam J oab Tash & Rachel J oy Tash Living Tri, Santa Rosa Valley, CA (US)

( * ) Notice: Subject to any disclaimer, the term of this patent is extended or adjusted under 35 U.S.C. 154(b) by 0 days.

(21) Appl. No.: 17/856,149

(22) Filed: Jul. 1, 2022

(65) Prior Publication Data

US 2024/0003128 A1 Jan. 4, 2024

(51) Int. Cl.
*E03C 1/308* (2006.01)

(52) U.S. Cl.
CPC ..... *E03C 1/308* (2013.01)

(58) Field of Classification Search
CPC ..... E03C 1/304–308; E03F 9/00–007
USPC ..... D32/14
See application file for complete search history.

(56) References Cited

U.S. PATENT DOCUMENTS 930,236 A * 8/1909 Schacht ..... E03C 1/308 292/DIG. 28
1,288,092 A 12/1918 McWane
1,594,831 A * 8/1926 Hartman ..... E03C 1/308 4/255.11
1,723,765 A * 8/1929 Churchill ..... E03C 1/306 4/255.05
1,758,541 A 5/1930 Simon
2,126,689 A * 8/1938 Pouliot ..... E03C 1/308 4/255.11
RE24,534 E 9/1958 Dahl
3,021,532 A * 2/1962 Gross ..... E03C 1/308 4/255.11
3,154,106 A 10/1964 Nooy
3,626,475 A 12/1971 Hicks
(Continued)

FOREIGN PATENT DOCUMENTS

DE 20013589 * 12/2001 ..... E03C 1/308

OTHER PUBLICATIONS

GTwater Products, Inc., TTMP Series Test Tee Mechanical Test Plug, Great for Multi-Level Testing! Installs In Seconds, Mar. 24, 2016, pp. 1-2.

(Continued)

*Primary Examiner* — David P Angwin
*Assistant Examiner* — Nicholas A Ros
(74) *Attorney, Agent, or Firm* — LYON & HARR, LLP; Richard T. Lyon

(57) ABSTRACT

A flexible plunger boot used with a plunger to unclog a drain includes a coupling section, bulbous seal, and periphery seal. The coupling section couples to the bottom end of the plunger. The bulbous seal has a hollow spherical shape with a maximum outside diameter that is larger than a diameter of a drain that the bulbous seal is inserted into and deforms inwardly to create an interference fit with the walls of the drain. The periphery seal has an annular ring shape that is smaller in diameter than the maximum outside diameter of the bulbous seal but larger in diameter than a drain opening whose diameter is too small for the bulbous seal to fit into. Whenever the periphery seal is pressed down against the surface surrounding the drain opening it flattens against the surface to create a mechanical seal with the surface.

19 Claims, 6 Drawing Sheets

(56) References Cited

U.S. PATENT DOCUMENTS

| | | | | |
|---|---|---|---|---|
| 4,429,568 | A | 2/1984 | Sullivan | |
| 4,430,887 | A | 2/1984 | Robert | |
| 4,442,703 | A | 4/1984 | Herman | |
| 4,460,019 | A | 7/1984 | Condon | |
| 4,745,641 | A * | 5/1988 | Tash | E03C 1/308 4/255.11 |
| 6,062,262 | A | 5/2000 | Tash | |
| 6,163,895 | A * | 12/2000 | Davenport | B08B 9/0322 4/255.06 |
| 6,192,525 | B1 * | 2/2001 | Tash | E03C 1/308 4/255.11 |
| 6,289,935 | B1 | 9/2001 | Tash | |
| 7,013,499 | B2 * | 3/2006 | Tash | E03C 1/30 4/255.11 |
| 7,021,337 | B2 | 4/2006 | Markham | |
| 7,062,800 | B1 * | 6/2006 | Alfred | E03D 9/00 4/255.11 |
| 7,849,882 | B1 | 12/2010 | Lee | |
| 9,243,829 | B1 | 1/2016 | Parnell | |
| 9,719,624 | B2 | 8/2017 | Jackson | |
| 9,914,849 | B2 * | 3/2018 | Bleecher | C09D 175/04 |
| 10,329,757 | B1 * | 6/2019 | Waite | E03D 9/00 |
| 10,683,958 | B1 | 6/2020 | Tash | |
| 2006/0254660 | A1 | 11/2006 | McIlwain | |
| 2008/0134421 | A1 * | 6/2008 | Sheffield | E03D 9/00 4/255.11 |
| 2008/0184783 | A1 | 8/2008 | Chromey | |
| 2010/0243090 | A1 | 9/2010 | Peterson | |
| 2012/0159700 | A1 * | 6/2012 | Iacampo, Sr. | E03C 1/304 4/255.05 |
| 2012/0189469 | A1 | 7/2012 | Chou | |
| 2016/0376777 | A1 * | 12/2016 | Burns | E03C 1/308 4/255.11 |
| 2018/0252612 | A1 | 9/2018 | Tash | |

OTHER PUBLICATIONS

Gtwater Products, Inc., TTMP Series Test Tee Mechanical Test Plug, Holds Up To 15 Stories Pressure Installs in Seconds!, Mar. 2014, pp. 1-2.

Oatey Company, Clean-Seal 2 Plug it . . . Fill it . . . Drain it!, http://www.oatey.com/doc/cleanseal2sellsheet1-16art.PDF, Jan. 2016, 1 page.

YouTube video, TTMP Test Tee Mechanical Plug, Sizes 6"-10" with (Water-Fill Feature), GT Water Products Inc., Feb. 26, 2016, total time: 4:07.

* cited by examiner

FLEXIBLE PLUNGER BOOT

BACKGROUND

Drains such as those in toilets, sinks, and tubs are typically unclogged by using a plunger comprised of a deformable head mounted on the end of an elongated handle or shaft. Plunger head designs typically include an air chamber or bellows coupled to a seal. During an unclogging operation, a plunger head seal is held over, or inserted into, the mouth of the drain while the plunger handle is reciprocated in an upward and downward motion that alternately contracts and enlarges the space within the head air chamber. This reciprocating motion then creates an alternating pressure and suction force in the drain passage that is often sufficient to dislodge an obstruction in the drain.

SUMMARY

Flexible plunger boot implementations described herein are used with a drain plunger to unclog an obstructed drain in a plumbing fixture. In one general implementation, the flexible plunger boot is releasably attachable to a bottom end of a drain plunger and includes a coupling section that includes an annular ring-shaped structure with a central aperture. The coupling section has a size and shape that facilitates releasably coupling it to the bottom end of the drain plunger. This general implementation of the flexible plunger boot also includes a bulbous seal that has a hollow spherical shape which is truncated at a top end and a bottom end. The top end of the bulbous seal depends from a bottom end of the coupling section. The bulbous seal has a maximum outside diameter that is larger than a diameter of a plumbing fixture drain that the bulbous seal is inserted into and is flexible enough to deform inwardly and form an interference fit with the walls of the plumbing fixture drain. This general implementation of the flexible plunger boot further includes a periphery seal having an inwardly concave annular ring shape with a central aperture that depends at its top end from the bottom end of the bulbous seal. The periphery seal is smaller in diameter than the maximum outside diameter of the bulbous seal but larger in diameter than a drain opening of, a plumbing fixture whose drain diameter is too small for the bulbous seal to fit into. The periphery seal is also flexible enough so that whenever it is pressed down against a surface surrounding a drain opening of the plumbing fixture, a lower portion of the periphery seal flattens against the surface to form a flat annular ring which creates a mechanical seal between the periphery seal and the surface.

In one implementation, the annular ring-shaped structure of the flexible plunger boot's coupling section has an exterior surface that is inwardly concave and an interior surface having a ring-shaped protrusion which interfaces with a bottom end of the drain plunger. In addition, the coupling section has a size and shape that facilitates releasably coupling the coupling section to the bottom end a drain plunger.

In one alternate implementation, the flexible plunger boot is permanently affixed to a bottom end of a drain plunger. In this implementation, the coupling section has a size and shape that facilitates its permanent attachment to the bottom end a drain plunger.

In one implementation, the flexible plunger boot is molded as one integrated part and exhibits a varying flexibility with height owing to a varying wall thickness. In this implementation, the coupling section is the least flexible part of the flexible plunger boot.

It should be noted that the foregoing Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more detailed description that is presented below.

DESCRIPTION OF THE DRAWINGS

The specific features, aspects, and advantages of the flexible plunger boot implementations described herein will become better understood with regard to the following description, appended claims, and accompanying drawings where:

DETAILED DESCRIPTION

In the following description of the flexible plunger boot implementations reference is made to the accompanying drawings which form a part hereof, and in which are shown, by way of illustration, specific implementations in which the flexible plunger boot can be practiced. It is understood that other implementations can be utilized and structural changes can be made without departing from the scope of the flexible plunger boot implementations.

It is also noted that for the sake of clarity specific terminology will be resorted to in describing the flexible plunger boot implementations described herein and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation", or "one version", or "another version", or an "exemplary version", or an "alternate version", or "one variant", or "another variant", or an "exemplary variant", or an "alternate variant" means that a particular feature, a particular structure, or particular characteristics described in connection with the implementation/version/variant can be included in at least one implementation. The appearances of the phrases "in one implementation", "in another implementation", "in an exemplary implementation", "in an alternate implementation", "in one version", "in another version", "in an exemplary version", "in an alternate version", "in one variant", "in another variant", "in an exemplary variant", and "in an alternate variant" in various places in the specification are not necessarily all referring to the same implementation/version/variant, nor are separate or alternative implementations/versions/variants mutually exclusive of other implementations/versions/variants.

Furthermore, to the extent that the terms "includes," "including," "has," "contains," variants thereof, and other similar words are used in either this detailed description or the claims, these terms are intended to be inclusive, in a manner similar to the term "comprising", as, an open transition word without precluding any additional or other elements.

1.0 Introduction

Figure 1:
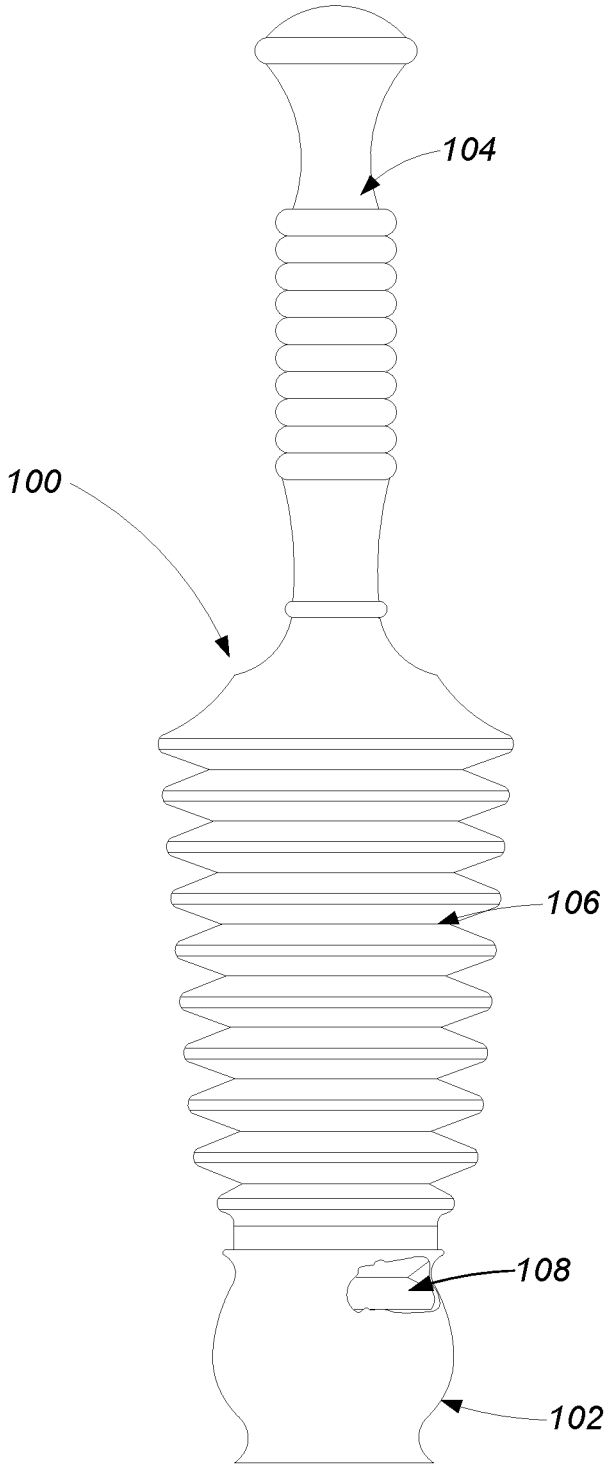
FIG. 1 is a diagram illustrating a side view, in simplified form, of an exemplary implementation of a flexible plunger boot installed on the bottom end of a drain plunger.

The flexible plunger boot implementations described herein are employed in conjunction with a drain plunger to clear the drain of a plumbing fixture (such as toilet, sink, bathtub, and so on) when it is clogged by an obstruction. Referring to FIG. 1, in general, the plunger 100 employed with the flexible plunger boot 102 includes an elongated handle 104 attached to an upper end of a compressible plunger head 106. It is noted that in the description to follow and in the claims the terms "top end" and "upper end" are used to denote the portion of a component that is closest to the handle of the plunger, and the terms "bottom end" and "lower end" are used to, denote the portion of a component that is furthest from the plunger handle. In one implementation, the plunger head 106 is a pleated bellows which is generally conical and can vary in diameter from top to bottom. Further, in other implementations, the collapsible plunger head can take the form of various conventional non-bellows configurations (such an inverted flexible cup) or a combination of a non-bellows and bellows configurations. As long as the plunger head has sufficient internal volume to produce satisfactory pressure and suction forces when compressed and expanded, the size and shape of the plunger head may be varied without affecting its performance, usability or durability. For example, the plunger head may take such shapes as a sphere, an oval, a cone, a pyramid, or it may have a rectangular cross-section, or it can have a shape which is any combination of these shapes. Further, the plunger head may also comprise fanciful shapes, or any other practical shape which is pleasing.

The plunger head 106 is connected to an outlet section that forms its lower end. Without the flexible plunger boot installed, the outlet section typically functions as a seal, but with the flexible plunger boot installed functions as a coupling structure 108. In one implementation, the coupling structure 108 has a size and shape that interfaces with and secures the flexible plunger boot 102 to the plunger 100, as will described in more detail in the sections to follow.

2.0 Flexible Plunger Boot

In general, the flexible plunger boot implementations described herein are designed to either seat securely within a drain opening, or alternately, in the case where the drain opening is smaller in diameter than a periphery seal forming the bottom end of the flexible plunger boot, to create a seal around the drain opening. An operator of a plunger equipped with the flexible plunger boot implementations described herein generally unclogs a plumbing fixture drain by placing the flexible plunger boot into position above or in a clogged drain such that it interfaces with the opening of the drain. This forms an interference fit and/or mechanical seal with the drain opening. Next, as force is applied downward on the handle of the plunger, the plunger head compresses and creates an increased pressure within the flexible plunger boot and against the obstruction in the drain. In cases where the flexible plunger boot is secured within the drain opening, this increased pressure in the flexible plunger boot causes the flexible wall of the middle portion of the boot to press with greater force against the interior wall of the drain, thereby enhancing the mechanical seal between the boot and the drain wall. Next, as the handle is pulled upwards, the plunger head expands and applies a suction force to the obstruction in the drain. The flexible plunger boot implementations described herein stay sealed to the opening of the drain via the suction force. The upward and downward motions are repeated creating reciprocating pressure and suction forces that dislodge an obstruction from within the drain, thereby facilitating clearing of the drain. The dislodged obstruction is typically drawn down the drainpipe when the plunger is removed.

The flexible plunger boot implementations described herein have many advantages. For example, as will be described in greater detail in the sections to follow, implementations of the flexible plunger boot can be releasably installed on the end of existing drain plungers. Thus, there is no need to purchase a plunger to realize the benefits afforded by the flexible plunger boot. Rather, the flexible plunger boot can be purchased separately and used on any plunger having an outlet section that is compatible with a coupling section of the flexible plunger boot. In addition, existing plungers can be upgraded to facilitate unclogging a wider variety of plumbing fixtures with very different drain opening sizes than they could without the flexible plunger boot. For example, the flexible plunger boot implementations described herein are versatile enough to unclog drains associated with toilets that have throat sizes and shapes that vary greatly from one model to another. In addition, the flexible plunger boot implementations described herein are capable of unclogging not just toilets but also garbage disposal drains, bathroom sink drains, kitchen sink drains, bathtub drains, to name a few, all with varying drain opening sizes.

Figure 2:
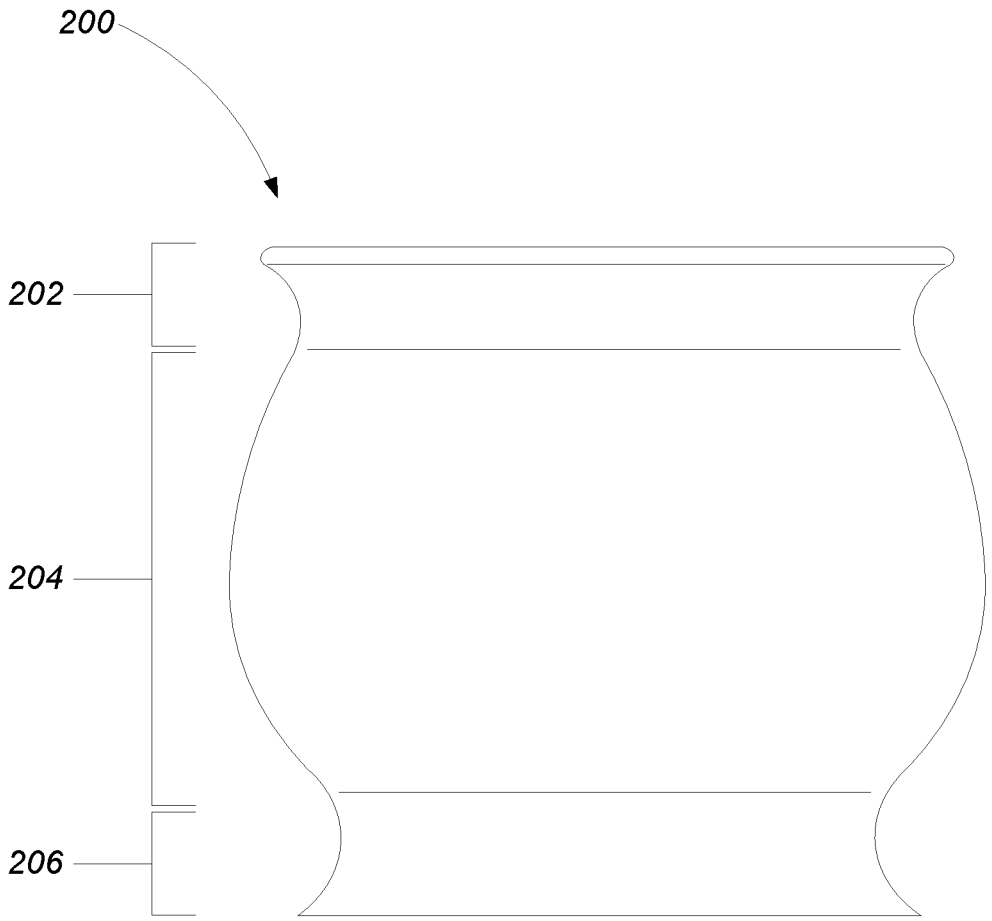
FIG. 2 is a diagram illustrating a side view, in simplified form, of an exemplary implementation of a flexible plunger boot.

FIG. 2 illustrates an exemplary implementation, in simplified form, of a flexible plunger boot. The flexible plunger boot depicted in FIG. 2 is just an example of a suitable implementation and is not intended to suggest any limitation as to the scope of use or functionality. Neither should the flexible plunger boot depicted in FIG. 2 be interpreted as having any dependency or requirement relating to any one or combination of the components discussed hereafter in this section. As shown in FIG. 2, the exemplary implementation of a flexible plunger boot 200 includes three sections, namely a coupling section 202 at the top end, a bulbous seal 204 in the middle, and a periphery seal 206 at the bottom end. The sections 202, 204, 206 of the flexible plunger boot 200 are hollow so as to collectively form a central void which is open at the bottom of the boot and which opens into the hollow interior of the plunger head to allow air and/or fluid to flow from the plunger head into the drain opening when the plunger is compressed.

2.1 Coupling Section

Figure 3:
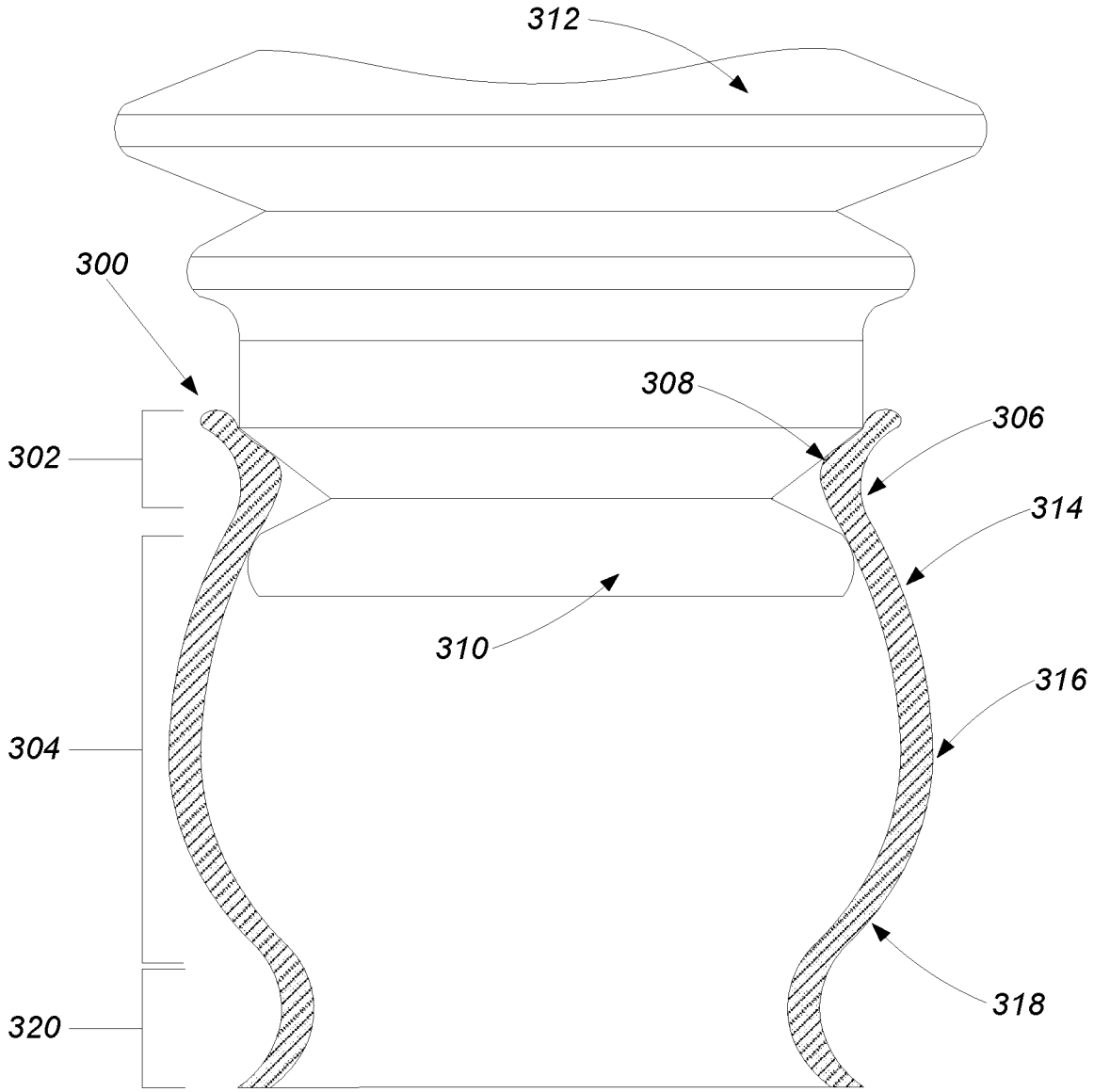
FIG. 3 is a diagram illustrating a cross-sectional side view, in simplified form, of an exemplary implementation of a flexible plunger boot.
Figure 4:
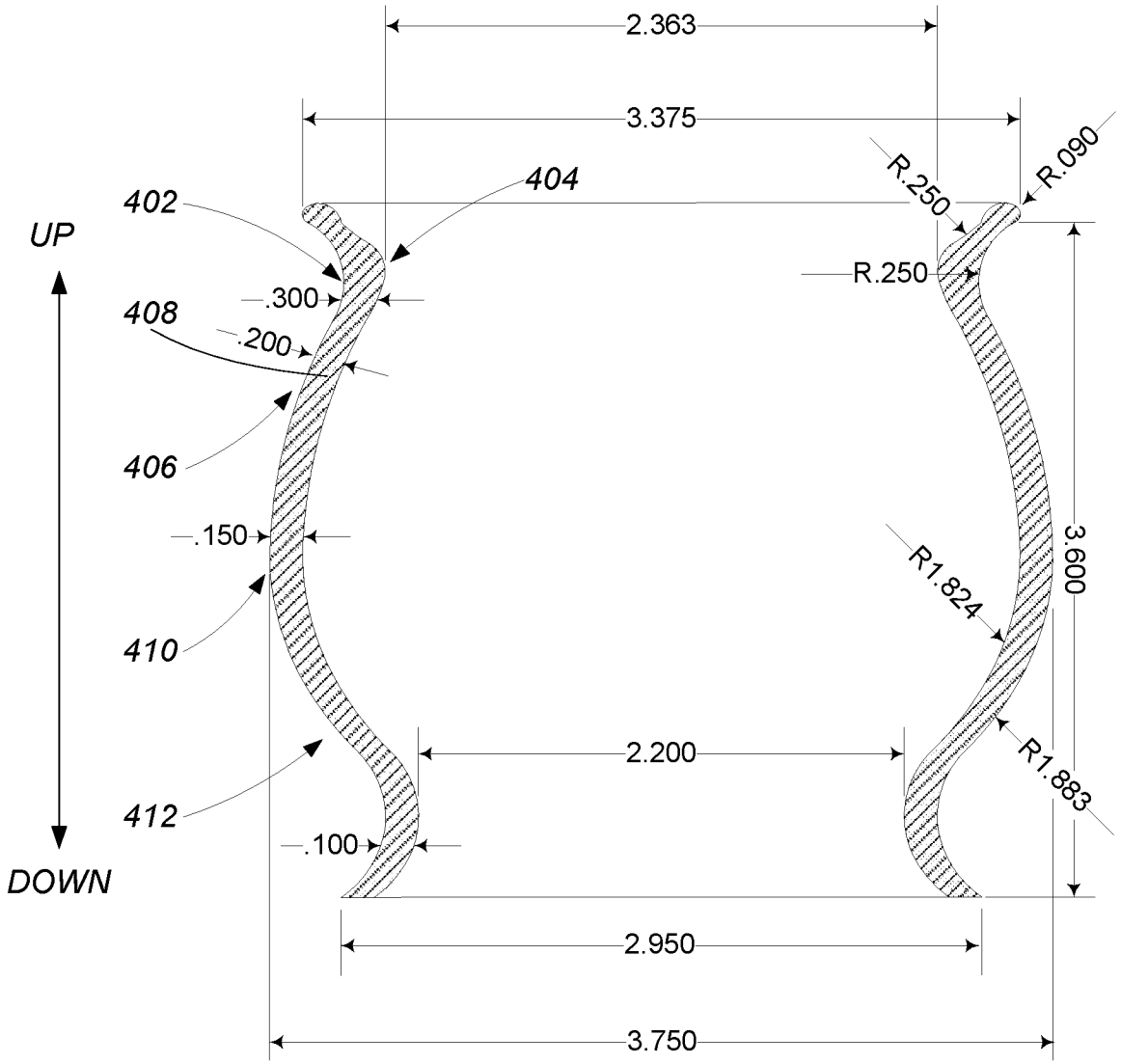
FIG. 4 is a diagram illustrating a cross-sectional side view, in simplified form, of an exemplary implementation of a flexible plunger boot including various radius and wall thickness dimensions.

In one implementation, the coupling section 202 of the flexible plunger boot is an annular ring-shaped section with a central aperture having a shape that facilitates its releasable coupling to the coupling structure (108 in FIG. 1) of a drain plunger. Referring to FIG. 3, in one implementation, the coupling section 302 of the flexible plunger boot 300 has an annular ring shape and a bottom end from which the top end of the bulbous seal 304 depends. The exterior surface 306 of the coupling section 302 is inwardly concave, and interior surface includes a ring-shaped protrusion 308. The implementation illustrated in FIG. 3 is designed to interface with the bottom-most seal structure 310 on the household drain plungers 312 described in U.S. Pat. No. 6,192,525. The coupling section 302 has a minimum interior diameter and flexibility that allows it to be securely, but releasably, attached to the bottom of the coupling structure 310 of the drain plunger 312. More particularly, the thickness of the coupling section 302 from the tip of the protrusion 308 to the exterior surface is made so as to produce a flexibility that is stiff enough to secure the coupling section to the coupling structure 310 of the drain plunger 312 and keep it in place under the normal conditions experienced with the upward and downward movements of the plunger during use. In one tested implementation, the desired degree of flexibility of the coupling section 402 was achieved using the natural rubber material sold by Goodyear Rubber Company of Southern California, 9615 Feron Blvd, Rancho Cucamonga, CA 91730 (hereinafter referred to as natural rubber) and employing wall thicknesses from the tip of the protrusion 404 to the exterior surface of the coupling section of 0.300 inches, as shown in FIG. 4.

While the foregoing description of the coupling section was directed to its attachment to the household drain plungers described in U.S. Pat. No. 6,192,525, it is not intended that the flexible plunger boot implementations described herein be limited to use with the aforementioned plungers. Rather, it is envisioned that the coupling section can be configured to interface with any plunger having a sealing structure amenable to attachment of a flexible plunger boot without departing from the scope of the flexible plunger boot implementations described herein.

2.2 Bulbous Seal

Referring again to FIG. 2, in one implementation, the bulbous seal 204 has a hollow spherical shape that is truncated at the top and bottom ends where it transitions to the coupling section 202 and periphery seal 206, respectively. The bulbous seal 204 is least flexible near its top end and its flexibility increases in the downward direction, such that the bulbous seal is more flexible in the middle portion of its height than at its top portion, and the bottom end of the bulbous seal is more flexible than the middle portion. Mile this variation in flexibility can be created using different materials at different heights, in the depicted implementation that bulbous seal is made of one type of material which is varied in thickness from top to bottom to create the desired flexibility. As to the degree of flexibility, referring again to FIG. 3, the bulbous seal 304 is stiffest at its top end 314 and the middle portion 316 of the bulbous seal is flexible enough to deform inwardly when the seal is introduced into a drain so as to form the previously described interference fit/mechanical seal between the boot 300 and the interior wall of the drain opening. The bottom end of the bulbous seal 318 is made to be flexible enough to collapse inwardly when a force is applied to the periphery seal 320 such that the upper portion of the periphery seal is forced into the interior of the bulbous seal, as will be described in more detail in the sections to follow. In one tested implementation, the foregoing variation in flexibility and degree of flexibility in the different portions of the bulbous seal was achieved using natural rubber and employing wall thicknesses as shown in FIG. 4. As shown in FIG. 4, the top end 408 of the bulbous seal 406 is 0.200 inches thick, the wall thickness then progressively decreases in the downward direction and is 0.150 inches thick at about the midpoint 410, and further decreases in the downward direction to the bottom end 412 where it is inches thick.

Figure 5:
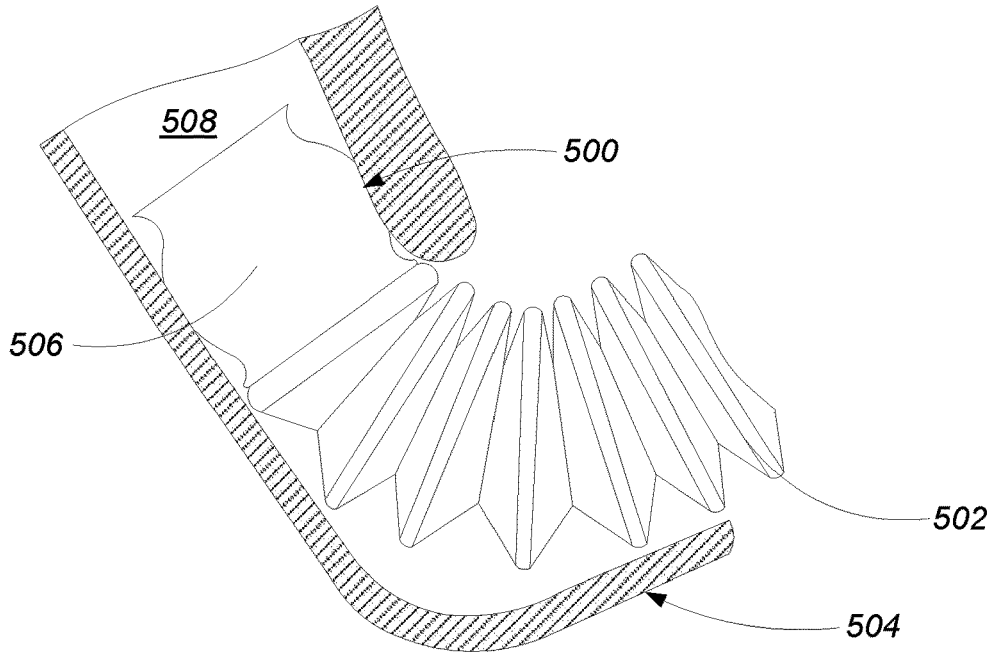
FIG. 5 is a diagram illustrating a plunger with the flexible plunger boot installed shown inserted into a toilet (which is depicted in a cross-sectional side view) where the bulbous seal of the flexible plunger boot is in sealing contact with the throat of the toilet.

The maximum outside diameter of bulbous seal occurs at approximately its mid-height, and in one implementation is made large enough to produce an interference fit in most toilet throats and garbage disposal drain openings. For example, in the tested implementation shown in FIG. 4, the maximum exterior bulbous seal diameter is 3.750 inches. It is believed a maximum exterior bulbous seal diameter is 3.750 inches will allow the bulbous seal to form an interference fit with the walls of most larger household drains, such as those found in toilets and garbage disposals. In addition, the flexibility of the bulbous seal allows it to deform inwards to form an interference fit in the drains of a wide variety of toilets with different drain diameters, as long as they do not exceed the maximum exterior bulbous seal diameter. For example, FIG. 5 illustrates a plunger 502 with the flexible plunger boot 500 installed shown inserted into a toilet 504 where the bulbous seal 506 of the flexible plunger boot is in sealing contact with the throat 508 of the toilet. As shown in FIG. 5, the middle portion of the bulbous seal 506 deflects inward to form a mechanical seal with the wall of the toilet throat 508.

However, an advantage of the detachable nature of the flexible rubber boot is that it can be removed from the bottom end of the plunger and replaced with another flexible plunger boot. Thus, if a plunger is to be used to unclog the drain of a plumbing fixture having a larger drain diameter than a typical toilet or sink and which exceeds the maximum outside diameter of a currently installed flexible plunger boot, then the currently installed flexible plunger boot can be replaced with one having a maximum exterior bulbous seal diameter that exceeds the unusually large drain opening.

2.3 Periphery Seal

Referring again to FIG. 2, in one implementation, the periphery seal 206 has an inwardly concave annular ring shape with a central aperture that depends at its top end from the bottom end of the bulbous seal 204. The periphery seal 206 is relatively shorter in height and smaller in diameter than the bulbous seal 204 but is larger in diameter than many sink or bathtub drain openings. Referring to FIG. 4, in one implementation, the minimum inside diameter of the periphery seal is 2.200 inches.

Figure 6:
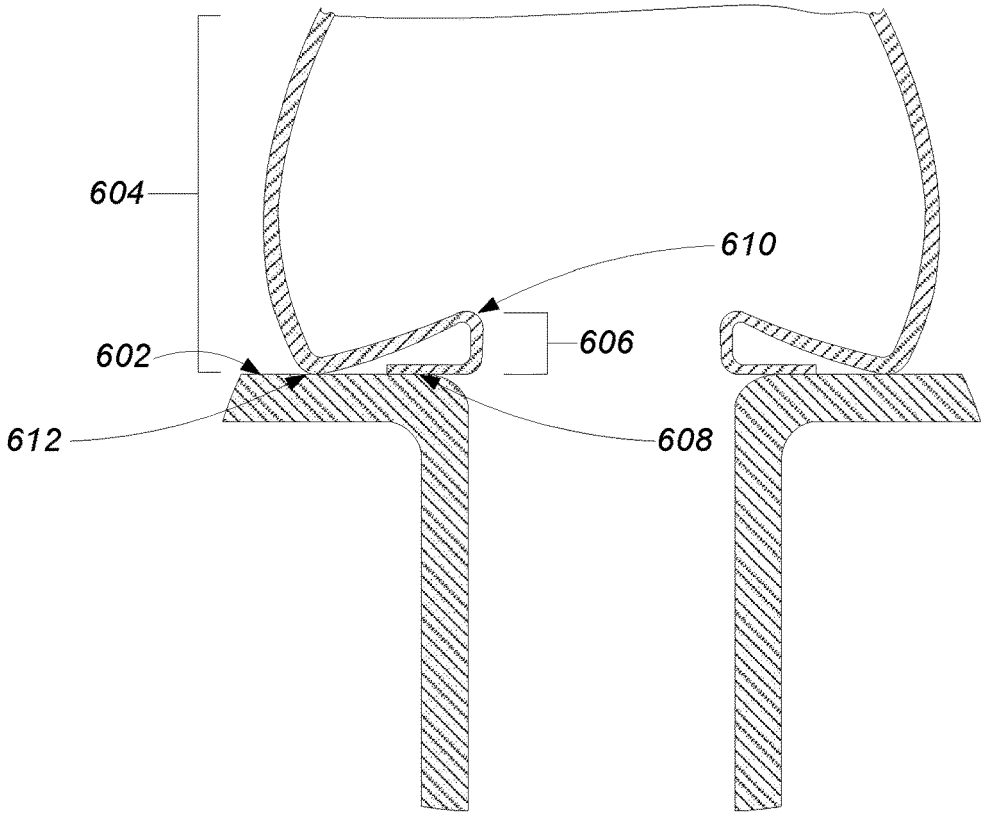
FIG. 6 is a diagram illustrating a fragmentary, cross-sectional side view, in simplified form, of an exemplary implementation of a flexible plunger boot showing the periphery seal in sealing contact with a drain opening of a typical bathroom sink.

Referring now to FIG. 6, the flexibility of the periphery seal 606 is made so that when it is pressed down against a surface 602 (such as the surface of a sink or bathtub surrounding a drain opening that is smaller than the opening formed by the periphery seal), as would be the case when the plunger is pressed down on a downstroke, the lower portion 608 of the periphery seal 606 flattens against the surface to form a flat annular ring which creates a mechanical seal between the periphery seal and the surface. At the same time, the upper portion 610 of the periphery seal is driven into the interior of the bulbous seal 604. It is noted that when the upper portion 610 of the periphery seal 606 is fully driven into the bulbous seal 604, the outside surface of the bulbous seal near its bottom end 612 contacts and is forced down onto the surface 602 of the sink or bathtub surrounding the drain opening, thereby creating a supplementary mechanical seal between the outside surface of the bulbous seal near its bottom end and the surface of the sink or bathtub surrounding the drain opening. In one tested implementation, the degree of flexibility of the periphery seal was achieved using natural rubber and employing wall thicknesses as shown in FIG. 4. As shown in FIG. 4, the wall of the periphery seal 414 is 0.100 inches thick.

As described previously, when the flexible plunger boot is first depressed and then pulled upward, as would be the case when the plunger is pulled up on an upstroke, the resulting suction force holds the periphery seal in place over the surface surrounding the drain opening and prevents the lateral slippage that can cause splashing and spillage of wastewater.

It is noted that once the obstruction has been dislodged, the suction force is released, and the plunger can be removed from the sink or bathtub. While the bottom end of the bulbous seal is flexible enough to collapse and allow the upper portion of the periphery seal to be driven into the interior of the bulbous seal, is it is also resilient enough so that the bulbous seal and the peripheral seal spring back to their original shapes and positions. This is advantageous as the user does not have to touch the flexible plunger boot to manually pull the peripheral seal back into place.

2.4 Flexible Plunger Boot Construction And Materials

In general, the flexible plunger boot can be constructed from one or more materials to produce the flexibility characteristic described previously. In addition, the flexible plunger boot can be constructed as one integrated part or multiple parts that are joined together. In one implementation, the flexible plunger boot is molded as single integrated piece from a single material with the wall thickness being varied to create the desired flexibility characteristics. For example, the flexible plunger boot can be molded from a durable and flexible rubber or plastic. This is advantageous as it makes the molding easy and inexpensive. In one implementation, the flexible plunger boot is molded as one integrated part made from natural rubber.

3.0 Additional Implementations And Advantages

While the flexible plunger boot has been described by specific reference to implementations thereof, it is understood that variations and modifications thereof can be made without departing from the true spirit and scope of the system. By way of example but not limitation, while the flexible plunger boot implementations described so far involved a removable structure, in one alternate implementation, the flexible plunger boot is permanently affixed to the end of a drain plunger.

Figure 7:
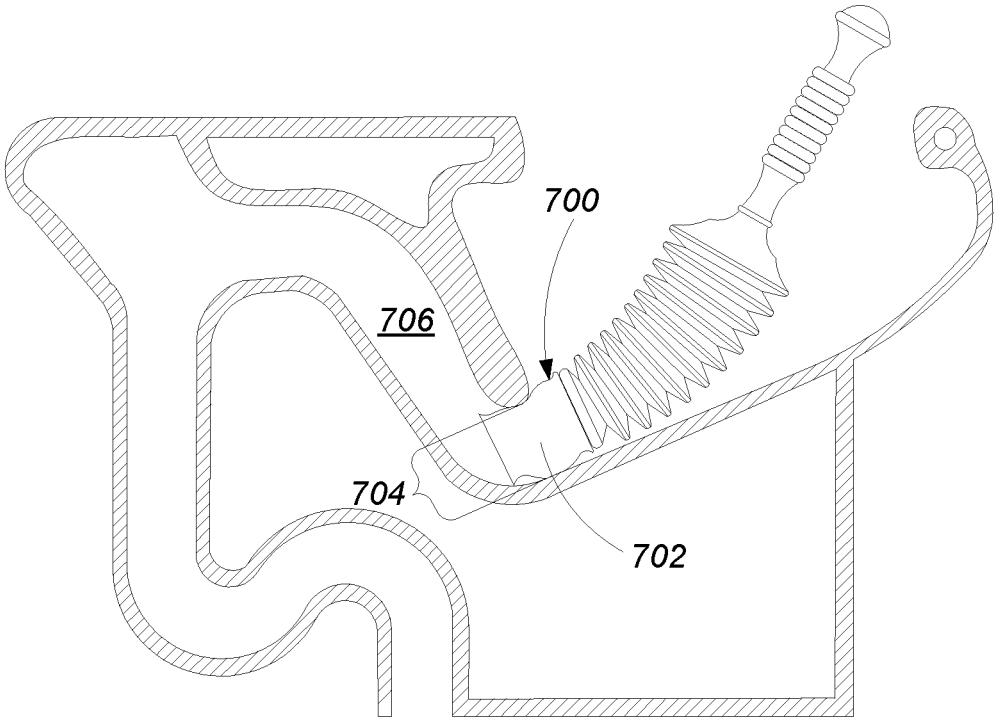
FIG. 7 is a diagram illustrating a plunger with the flexible plunger boot installed shown inserted into a toilet (which is depicted in a cross-sectional side view) where the bulbous seal of the flexible plunger boot is sealing the opening to the throat of the toilet.

Whether the flexible plunger boot is releasably and permanently affixed to a plunger, its shape and flexibility provide additional capabilities and advantages when installed on a plunger. For example, the orientation of the opening to a toilet throat can present a non-uniform opening that the flexible plunger boot must seal. FIG. 7 is an example of such a condition where the bulbous seal 702 of the flexible plunger boot 700 deflects slightly to seal the opening 704 to the toilet throat 706 on the bottom of the opening but is required to deflect considerably more on the top part of the opening in order to form a seal. Still further, as can be imagined, for aesthetic or practical purposes, a plumbing fixture may have a non-circular drain or throat (e.g., oval, or square with rounded corners, rectangular with rounded corners, triangular with rounded corners, and so on). The ability of the bulbous seal of the flexible plunger boot to readily deflect to different degrees around its circumference makes it particularly advantageous for sealing non-circular drains and toilet throats.

It is also noted that although the foregoing subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims.

The aforementioned implementations have been described with respect to interaction between several components. It will be appreciated that such implementations and components can include those components or specified sub-components, some of the specified components or sub-components, and/or additional components, and according to various permutations and combinations of the foregoing. Sub-components can also be implemented as components coupled to other components rather than included within parent components (e.g., hierarchical components).

Wherefore, what is claimed is:

1. A flexible plunger boot that is releasably attachable to a bottom end of a drain plunger and which is used with the drain plunger to unclog an obstructed drain in a plumbing fixture, comprising:

a coupling section comprising an annular ring-shaped structure with a central aperture, said coupling section having a size and shape that facilitates releasably coupling the coupling section to the bottom end of a drain plunger, said drain plunger comprising of a deformable head with an air chamber, a seal at said bottom end of the drain plunger which is configured to interface with a drain and an elongated handle mounted to a top end of the deformable head, and wherein said coupling section releasably couples to the drain plunger via an annular closed-loop protrusion which extends inwardly from an interior surface of the coupling section into the central aperture and which interfaces with an exterior surface of the seal at said bottom end of a drain plunger;

a bulbous seal comprising a spherical shape that is truncated at a top end and a bottom end and has a hollow interior, wherein said top end of the bulbous seal depends from a bottom end of the coupling section and the hollow interior of the spherical shape opens into the central aperture of the coupling section, and wherein the bulbous seal has a maximum outside diameter that is larger than a diameter of a plumbing fixture drain that the bulbous seal is inserted into and is flexible enough to deform inwardly and form an interference fit with the walls of the plumbing fixture drain whenever the bulbous seal is inserted into the plumbing fixture drain; and a periphery seal comprising an inwardly concave annular ring shape with a central aperture that depends at its top end from the bottom end of the bulbous seal, said periphery seal being smaller in diameter than the maximum outside diameter of the bulbous seal but larger in diameter than a drain opening of a plumbing fixture whose drain diameter is too small for the bulbous seal to fit into, and wherein the periphery seal is flexible enough so that whenever it is pressed down against a surface surrounding a drain opening of said plumbing fixture, a lower portion of the periphery seal flattens against the surface to form a flat annular ring which creates a mechanical seal between the periphery seal and the surface.

2. The flexible plunger boot of claim 1, wherein the exterior surface of the coupling section is inwardly concave.

3. The flexible plunger boot of claim 1, wherein the coupling section is flexible enough and the central aperture of the coupling section has a diameter large enough to allow the coupling section to be releasably coupled to the bottom end of the drain plunger, but stiff enough to secure the coupling section to the bottom of the plunger and keep it in place under the conditions experienced with the upward and downward movements of the plunger during use.

4. The flexible plunger boot of claim 1, wherein whenever the periphery seal is larger in diameter than a drain opening of a plumbing fixture whose drain diameter is too small for the bulbous seal to fit into, and the periphery seal is pressed down against a surface surrounding a drain opening of said plumbing fixture during a downstroke of the to drain plunger to form a flat annular ring which creates a mechanical seal between the periphery seal and the surface, upon an upstroke of the drain plunger, a suction force is created within the drain plunger and flexible plunger boot which holds the periphery seal in place against the surface surrounding a drain opening.

5. The flexible plunger boot of claim 1, wherein the flexible plunger boot is formed of flexible resilient plastic or rubber material.

6. The flexible plunger boot of claim 1, wherein the flexible plunger boot exhibits a varying flexibility with height with the coupling section being the least flexible part of the flexible plunger boot.

7. The flexible plunger boot of claim 6, wherein the variance in flexibility with height of the flexible plunger boot is created using different materials at different heights.

8. The flexible plunger boot of claim 6, wherein the variance in flexibility with height of the flexible plunger boot is created by varying the wall thickness, said wall thickness being greatest in the coupling section and decreasing in thickness from the coupling section downward.

9. The flexible plunger boot of claim 1, wherein the bulbous seal exhibits a varying flexibility with height and is least flexible at its top end, more flexible in the middle portion of its height than at its top end, and more flexible at its bottom end than in the middle portion.

10. The flexible plunger boot of claim 9, wherein the variance in flexibility with height of the bulbous seal is created using different materials at different heights.

11. The flexible plunger boot of claim 9, wherein the variance in flexibility with height of the bulbous seal is created by varying the wall thickness of the bulbous seal with the wall thickness being greatest at the top end and decreasing in thickness from the top end to the bottom end.

12. The flexible plunger boot of claim 9, wherein the bottom end of the bulbous seal exhibits a degree of flexibility that causes it to collapse inwardly when a downward force is applied to the periphery seal such that an upper portion of the periphery seal is forced into the interior of the bulbous seal and the outside surface of the bulbous seal adjacent its bottom end contacts and is forced down onto the surface surrounding a drain opening of a plumbing fixture having a drain diameter that is smaller than the central aperture of the periphery seal, thereby creating a supplementary mechanical seal between the outside surface of the bulbous seal and the surface surrounding the drain opening of the plumbing fixture.

13. The flexible plunger boot of claim 12, wherein whenever the downward force applied to the periphery seal that forced the upper portion of the periphery seal into the interior of the bulbous seal is ceased and the periphery seal is removed from the surface surrounding a drain opening of a plumbing fixture, the bulbous seal and periphery seal both automatically spring back to an un-collapsed shape and position.

14. A flexible plunger boot that is releasably attachable to a bottom end of a drain plunger and which is used with the drain plunger to unclog an obstructed drain in a plumbing fixture, comprising:

a coupling section comprising an annular ring-shaped structure with a central aperture wherein the exterior surface of the coupling section is inwardly concave and the interior surface of the coupling section has an annular closed-loop protrusion which extends inwardly from the interior surface of the coupling section into the central aperture, said coupling section having a size and shape that facilitates releasably coupling the coupling section to the bottom end of a drain plunger, said drain plunger comprising of a deformable head with an air chamber, a seal at said bottom end of the drain plunger which is configured to interface with a drain and an elongated handle mounted to a top end of the deformable head, and wherein said coupling section releasably couples to the drain plunger via the annular closed-loop protrusion which interfaces with an exterior surface of the seal at said bottom end of a drain plunger;

a bulbous seal comprising a spherical shape that is truncated at a top end and a bottom end and has a hollow interior, wherein said top end of the bulbous seal depends from a bottom end of the coupling section and the hollow interior of the spherical shape opens into the central aperture of the coupling section, and wherein the bulbous seal has a maximum outside diameter that is larger than a diameter of a plumbing fixture drain that the bulbous seal is inserted into and is flexible enough to deform inwardly and form an interference fit with the walls of the plumbing fixture drain whenever the bulbous seal is inserted into the plumbing fixture drain;

a periphery seal comprising an inwardly concave annular ring shape with a central aperture that depends at its top end from the bottom end of the bulbous seal, said periphery seal being smaller in diameter than the maximum outside diameter of the bulbous seal but larger in diameter than a drain opening of a plumbing fixture whose drain diameter is too small for the bulbous seal to fit into, and wherein the periphery seal is flexible enough so that whenever it is pressed down against a surface surrounding a drain opening of said plumbing fixture, a lower portion of the periphery seal flattens against the surface to form a flat annular ring which creates a mechanical seal between the periphery seal and the surface; and wherein the flexible plunger boot is molded as one integrated part from natural rubber and exhibits a varying flexibility with height owing to a varying wall thickness with the coupling section being the least flexible part of the flexible plunger boot.

15. The flexible plunger boot of claim 14, wherein a prescribed degree of flexibility of the coupling section is created by employing a wall thickness measured from the tip of the protrusion to the exterior surface of the coupling section of 0.300 inches.

16. The flexible plunger boot of claim 14, wherein a prescribed degree of flexibility of the bulbous seal is created by employing a wall thickness at the top end of the bulbous seal of 0.200 inches, creating a progressively decreasing wall thickness in the downward direction with the wall thickness being 0.150 inches at the midpoint in height of the bulbous seal and further decreasing in the downward direction to the bottom end of the bulbous seal wherein the wall thickness is 0.100 inches.

17. The flexible plunger boot of claim 14, wherein a prescribed degree of flexibility of the periphery seal is created by employing a wall thickness of 0.100 inches.

18. The flexible plunger boot of claim 14, wherein the maximum outside diameter of the bulbous seal is 3.750 inches.

19. The flexible plunger boot of claim 14, wherein the minimum inside diameter of the periphery seal is 2.200 inches.

* * * * *